US005940878A

United States Patent [19]

Hattori et al.

[11] Patent Number: 5,940,878

[45] Date of Patent: Aug. 24, 1999

[54] WATERTIGHT SUIT

[75] Inventors: Seiji Hattori; Tetsuo Yoshizawa, both of Ebina, Japan

[73] Assignee: Apollo Sports Co., Ltd., Kanagawa, Japan

[21] Appl. No.: 08/973,812

[22] PCT Filed: Mar. 28, 1996

[86] PCT No.: PCT/JP96/00833

§ 371 Date: Dec. 9, 1997

§ 102(e) Date: Dec. 9, 1997

[87] PCT Pub. No.: WO97/00808

PCT Pub. Date: Jan. 9, 1997

[30] Foreign Application Priority Data

Jun. 20, 1995 [JP] Japan ..... 7-153345

[51] Int. Cl.[6] ..... F16K 15/14; A62B 11/04

[52] U.S. Cl. ..... 2/2.15; 137/512.23; 137/522

[58] Field of Search ..... 2/2.15, 2.14, 456, 2/457, 2.11; 137/512.23, 138.54, 522, 543.23

[56] References Cited

U.S. PATENT DOCUMENTS 2,989,752 6/1961 Sloane ..... 2/2.1
3,740,764 6/1973 Elfstrom et al. ..... 2/2.1
4,103,704 8/1978 Richards ..... 137/522
4,229,832 10/1980 Dickson ..... 137/81.2
4,579,147 4/1986 Davies et al. ..... 137/854
5,697,396 12/1997 Kamitani ..... 137/81.2
5,771,924 6/1998 Huygen ..... 137/522

*Primary Examiner*—John J. Calvert
*Assistant Examiner*—Tejash D Patel
*Attorney, Agent, or Firm*—Jordan and Hamburg LLP

[57] ABSTRACT

A watertight suit is capable of properly discharging air within the suit and safely maintaining a diver's position in the water. The suit includes an air outlet valve provided in an end section of a leg part, the air outlet valve functioning to discharge air from the inside of the leg part. Another air outlet valve can also be provided in an upper body part of the suit. An air inlet introduces air into the watertight suit as necessary to equalize external pressure. Where an automatic air outlet valve is provided, air in excess of external pressure is vented through the outlet valves automatically as warranted by the diving conditions, keeping an even balance of pressure even when air is excessively supplied form the air source through the inlet valve.

7 Claims, 8 Drawing Sheets

WATERTIGHT SUIT

BACKGROUND OF THE INVENTION

The present invention relates to a watertight suit.

Several types of watertight suits, for example, a dry suit used for diving, a life jacket, a fisherman's long rubber pants, etc., are well known.

The dry suit mentioned above generally includes an air inlet valve for introducing air into the inside of the dry suit from an air tank to permit adjustment of inner air pressure according to diving depth, etc., and an air outlet valve for discharging the air from the inside of the dry suit. In such dry suits, the air outlet valves can discharge the air when a diver is in a horizontal position or a standing position, in which his head is located above the horizontal plane, in the water. The air outlet valve is usually disposed an upper arm part of the dry suit to facilitate operation.

Since the air outlet valve is usually located in the upper part of the dry suit, the air in the dry suit concentrates in leg parts of the dry suit when the diver's legs are located above the horizontal line in the water. The air in the leg parts concentrically lifts the diver's legs upward, so that the diver cannot change his position in the water. When the diver's legs are lifted upward, outer water pressure around the legs is reduced, and a volume of the air in the leg parts of the watertight suit is expanded. As a consequence, the buoyant force applied to the leg parts is increased as the diver moves upward in the water. In the worst case, the diver rises to the water surface in a very short time, so that accidents may result, for example, development of a caisson disease.

Conventionally, divers wear weights in an attempt to prevent the accidents caused by the greater buoyant force, but such precautions do not entirely eliminate such accidents.

If a fisherman wearing long rubber pants accidentally falls into the water, his legs are lifted in the water because the air is trapped in the leg parts of the long rubber pants. As a result, he cannot lift his face above the surface of the water, and therefore is unable to breathe.

It is therefore an object of the present invention to provide a watertight suit capable of properly discharging the air within the suit and keeping the diver's position in the water.

SUMMARY OF THE INVENTION

To solve the above described technical problems, the present invention has the following structures.

The watertight suit of the present invention comprises an air outlet valve disposed in an end section of a leg part, the air outlet valve being capable of discharging air contained in the inside of the end section. By virtue of this structure, the air outlet valve is capable of properly discharging the air in the leg part. Therefore, the diver's legs are prevented from lifting upward in the water. The diver can therefore properly maintain his position in the water.

In accordance with an embodiment of the invention, the watertight suit, the air outlet valve may be an automatic valve, which is capable of automatically discharging air contained in the inside of the watertight suit when inner air pressure is higher than a prescribed pressure which is higher than the outer water pressure, and which is capable of preventing water from invading the inside of the watertight suit even when the outer water pressure is higher than the inner air pressure. The automatic valve automatically responds in the case of emergency, thereby improving the safety of the watertight suit.

In the watertight suit, the automatic valve may generally comprise a base section having an air outlet and a valve seat which is formed on an edge of the air outlet. The watertight suit further comprises a cover section having a vent hole being capable of communicating to the outside of the watertight suit, the cover section being detachably attached to and covering the base section. The watertight suit also includes an open-close body being normally biased toward the valve seat by a spring provided between the cover section and the open-close body so as to close the air outlet. The open-close body automatically opens the air outlet when the inner pressure is higher than the outer pressure, whereby the air in the watertight suit can be properly discharged, and no water can invade the watertight suit.

In another embodiment of the watertight suit, the open-close body may comprise a holder section being made of a tough material, the holder section being capable of covering over the air outlet, and a ring member being made of an elastic material, the ring member being capable of watertightly closing a gap between the holder section and the valve seat, whereby a perfect waterproof suit can be realized.

In a further embodiment of the watertight suit, the watertight suit may be a dry suit, and an additional air outlet valve may be provided in an upper body part of the dry suit.

In yet another embodiment of the watertight suit, the additional outlet valve of the previous embodiment may be an automatic valve such that air can be automatically discharged.

In still a further embodiment of the watertight suit, the additional outlet valve may be an automatic valve which is capable of being automatically and manually opened and closed, whereby the safety of the watertight suit can be improved.

In the watertight suit according to still another embodiment, the automatic valve may comprise a base section fixed to the watertight suit, the base section having an air outlet and a valve seat which is formed on an edge of the air outlet. In such embodiment, a cover section having a vent hole capable of communicating to outside of the watertight suit is detachably attached to the base section so as to cover the base section. An open-close body is provided, which is normally biased toward the valve seat by a valve spring provided between the cover section and the open-close body so as to close the air outlet, the open-close body opening the air outlet when the inner air pressure is higher than the outer water pressure. A switching member is provided, having a shaft section which is pierced through and watertightly slidably fitted in a throughhole formed in a center of the open-close body. A button section is further provided at an outer end of the shaft section, whereby the switching member can be pushed toward the inside of the watertight suit by a finger which is inserted in a through-hole formed in the cover section. A button spring is provided between the open-close body and the button section of the switching member, the button spring normally biasing the switching member toward the outside of the watertight suit. Further, a supporting section is provided in the air outlet of the base section, and a pushing member is connected with the supporting member and the switching member, the pushing member being moved toward the outside of the watertight suit so as to move the open-close body to open the air outlet when the switching member is pushed toward the inside of the watertight suit, whereby the air in the watertight suit can be automatically and manually discharged therefrom in a reliable manner.

In accordance with yet another embodiment, the watertight suit may further comprise an automatic air inlet valve communicated to an air tank, the automatic air inlet valve being capable of supplying air into the watertight suit from the air tank. The air can be automatically introduced into and discharged from the watertight suit in a precise manner.

In yet another embodiment of the watertight suit, the automatic air inlet valve may comprise an air path communicating to the inside of the watertight suit, wherein the air is supplied to the inside thereof from the air tank via the air path. The automatic valve further includes a closing member biased to close the air path by pressure of the air supplied from the air tank, and opening the air path when the closing member is moved against the pressure of the air supplied therefrom. An inner spring is provided which normally biases the closing member to close the air path. A diaphragm is also provided which airtightly divides the air path and the inside of the watertight suit from the outside thereof, the diaphragm being capable of inwardly deforming to move the closing member against elasticity of the inner spring so as to automatically introduce the air into the inside of the watertight suit when the inner air pressure is lower than the outer water pressure, whereby the air can be automatically introduced into and discharged from the watertight suit in a precise manner.

The above, and other objects, features and advantages of the present invention will become apparent from the following description read in conjunction with the accompanying drawings, in which like reference numerals designate the same elements.

DETAILED DESCRIPTION OF THE INVENTION

Figure 1:
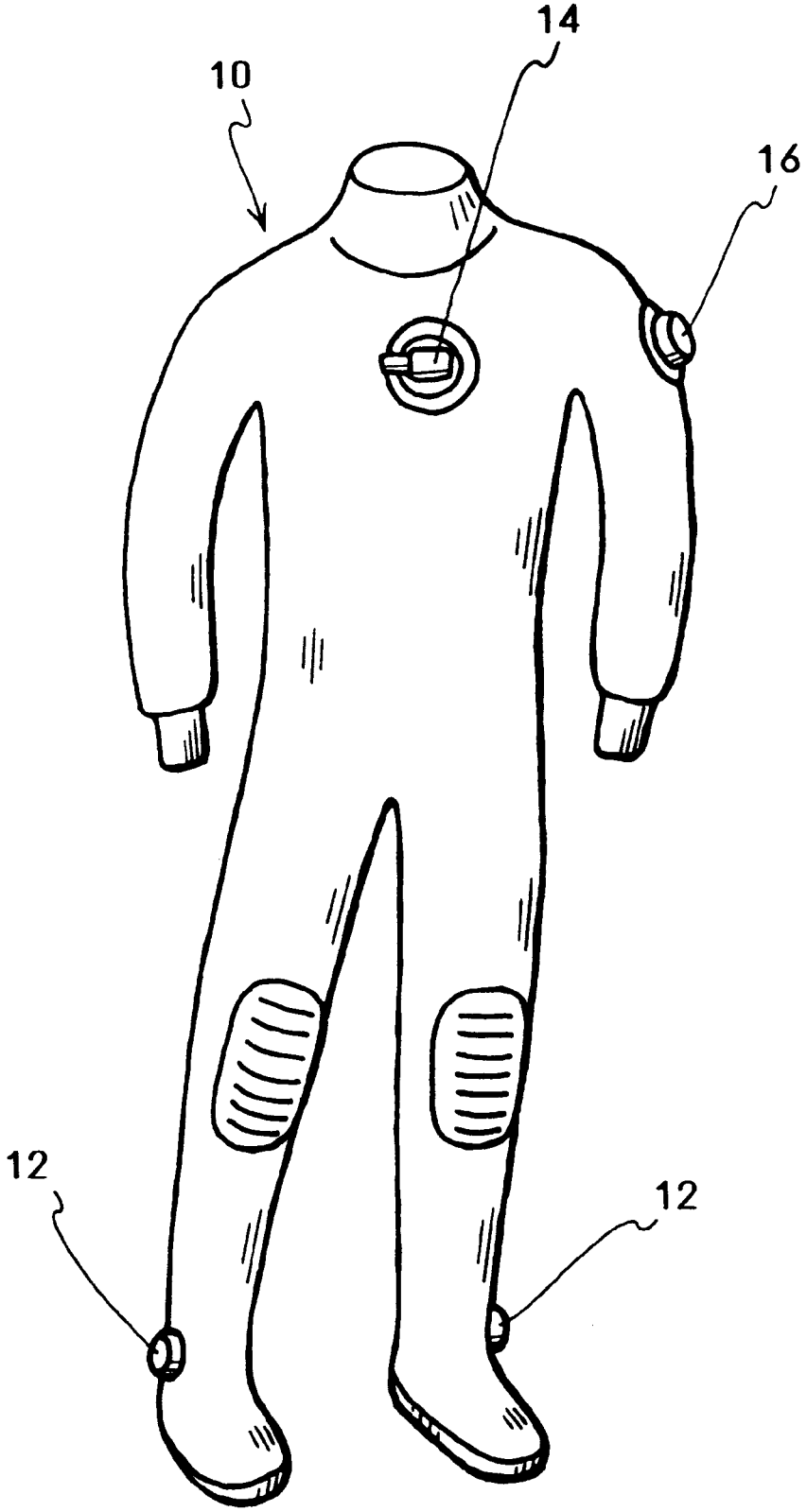
FIG. 1 is a perspective view of a dry watertight suit in accordance with an embodiment of the present invention.

Referring now to the figures, and in particular FIG. 1, an embodiment of the invention is depicted for use as a watertight dry suit.

A reference numeral 10 indicates a dry suit or a watertight suit capable of watertightly covering a diver's body. An air inlet valve 14 is provided for introducing the air from an air tank (not shown) to the inside of the dry suit 10. A main air outlet valve 16 is further provided for discharging the air from the dry suit 10.

Automatic air outlet valves, indicated by the reference numerals 12, are provided in end sections of leg parts of the dry suit 10, such that they are capable of discharging the air in the inside of the end sections thereof. The automatic air outlet valves 12 are advantageously provided at positions close to the tiptoes, but may be alternatively provided, for example, at ankle parts so as not to interfere with swimming fins, etc. To effectively discharge the air, the outlet valves 12 should be provided between knee parts and the tiptoe parts of the dry suit. Such structure operates to prevent the diver's legs from lifting upward in the water, and thereby permits the diver to properly maintain his position in the water. In particular, even if the air in the dry suit is transferred to the leg parts when the diver changes his position in the water, the air inside can be discharged by the air outlet valves (the automatic air outlet valves 12 in the present embodiment), which are provided advantageously at positions close to the tiptoes or the end sections of the leg parts (for example, the ankle parts in the depicted embodiment), and the diver can therefore properly maintain his position in the water.

The automatic air outlet valves 12 are capable of automatically discharging the air from the inside of the dry suit when inner air pressure is higher than a prescribed pressure, which is higher than outer water pressure, and they are capable of preventing water from invading into the inside of the dry suit, operating like a check valve even if the outer water pressure is higher than the inner air pressure. By virtue of this structure, the automatic air outlet valves can automatically work in case of an emergency, so that the safety of the dry suit can be improved.

The detail structure of the automatic air outlet valve 12 type shown in FIG. 1 will be explained below with reference to FIGS. 2 and 3.

Figure 2:
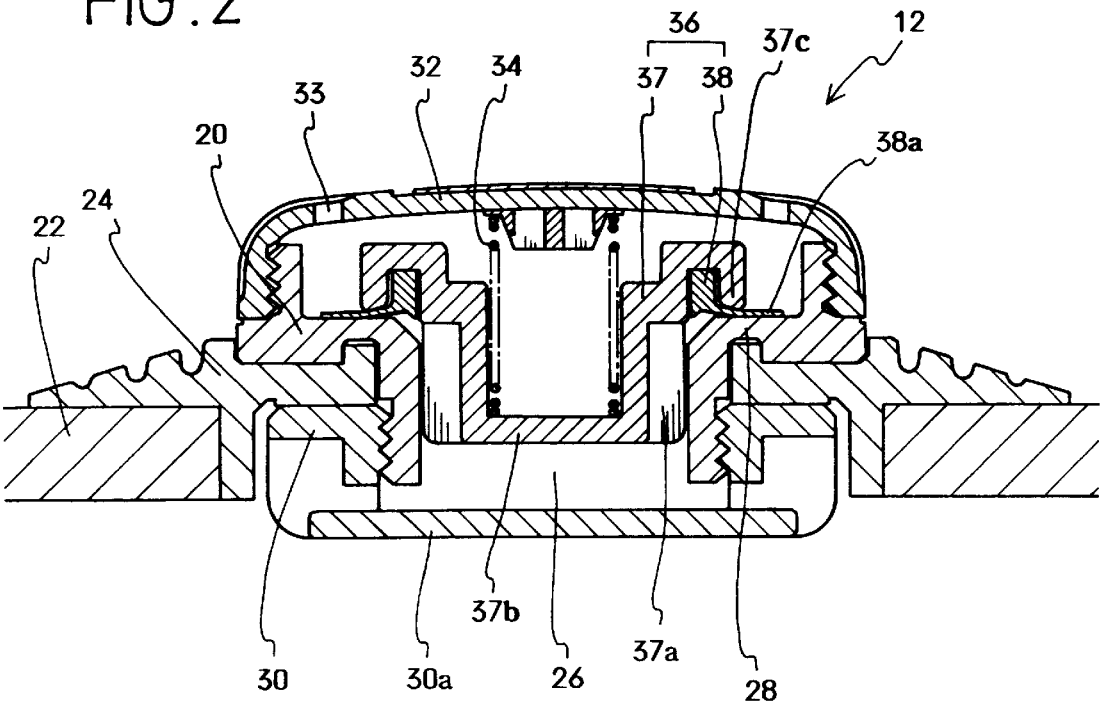
FIG. 2 is a sectional view of an air outlet valve of the embodiment of FIG. 1.
Figure 3:
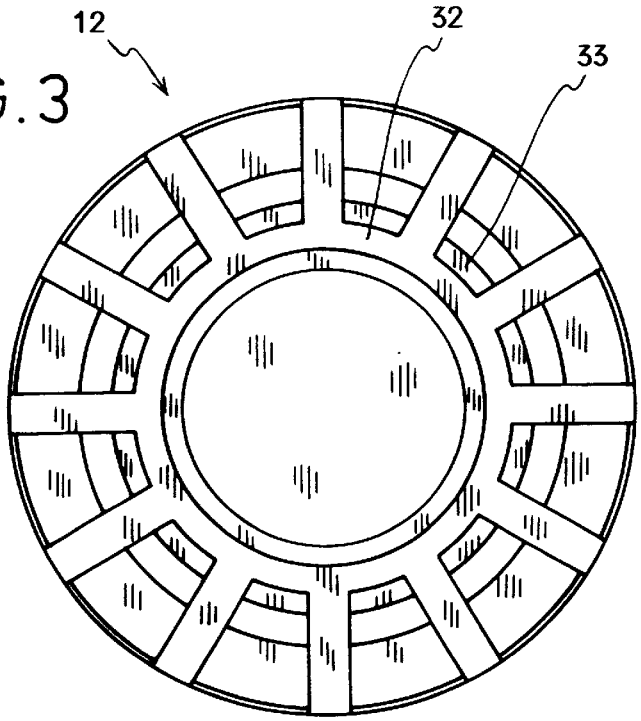
FIG. 3 is a plan view of the air outlet valve shown in FIG. 2.

Turning now to FIGS. 2 and 3, a base section 20 is attached to a circular opening section of a donut-shaped rubber sheet 24, which is fixed to a suit material 22 of the diving suit (the dry suit), so that the base section 20 forms an air outlet 26. A valve seat 28 is formed in an edge of the air outlet 26 of the base section 20. In the present embodiment, a male screw section of the base section 20 is threadably engaged with a female screw section of a back cap 30, which is provided on an inner side of the rubber sheet 24. The rubber sheet 24 is pinched between the base section 20 and the back cap 30, so that the base section 20 can be fixed to the circular opening section of the rubber sheet 24. Circular projections (not shown) are formed, which are coaxial to the circular opening section, on surfaces of the base section 20 and the back cap 30 which contact the suit material, so that the base section 20 and the back cap 30 can be watertightly fixed to the rubber sheet 24. Note that, a reference numeral 30*a* indicates a plate section, which forms a part of the back cap 30 so as not to close the air outlet 26.

A cover section 32 is provided, which covers over the base section 20 and which is screwed together with the base section. The cover section 32 has vent holes 33, which communicate with the outside of the dry suit.

An open-close body 36 is provided, which is always biased toward the valve seat 28 by a spring 34 elastically provided between an upper face of the open-close body 36 and an inner upper face of the cover section 32, to close the air outlet 26, and which automatically moves toward the outside of the dry suit (upward in the drawing) and opens the air outlet 26 against the elasticity of the spring 34 when the inner air pressure of the dry suit 10 is higher than the outer water pressure. By virtue of such structure, the air in the dry suit can be properly discharged, but water cannot invade into the interior of the suit.

The open-close body 36 comprises a holder section 37 made of a tough material, and a ring member 38, which is made of an elastic material, and whose outer edge is radially extended from an outer edge of the holder section 37. An inner edge of the ring member 38 is fitted in a circular groove formed in a lower face of an outer edge section of the holder section 37. Since the outer water pressure presses against the holder section 37 and the ring member 38, and they are not deformed, the water cannot invade into the dry suit 10. A lower section 37*a* of the holder section 37 slidably contacts an inner circumferential face of the air outlet 26 of the base section 20. Such structure permits properly guided vertical movement of the open-close body 36.

The automatic air outlet valve 12 includes the open-close body 36 and the spring 34 for biasing the open-close body 36, so that the amount of the air in the dry suit can be defined by adjusting the biasing force or the elasticity of the spring 34. As such, the automatic air outlet valve 12 acts as an automatic pressure control valve. The spring 34 is not limited to a coil spring of the depicted embodiment. Spring 34 may alternatively take the form of an elastic member, for example, a leaf spring. The biasing force of the spring 34 may be optionally defined according to diving conditions, but it is usually defined in an advantageous range of 20–30 cm $H_2O$ to permit automatic outlet valve 12 to properly discharge the air to prevent the diver from inverting in the water and effectively work as the check valve.

The biasing force of the spring 34 may be adjustable. By employing an adjustable spring, the inner air pressure can be properly balanced with the buoyant force exerted on the leg parts even if various divers' physical characteristics are different. Furthermore, the automatic air outlet valve 12 may include a locking mechanism for optionally inhibiting the function of the valve.

In the present embodiment, the open-close body 36 automatically opens the valve seat on the basis of prescribed pressure difference (namely, the automatic air outlet valve has an automatic valve function only), but the main air outlet valve 16, which is capable of manually discharging the air, may be substituted for the automatic air outlet valve 12.

The automatic air outlet valve 12 has a simple structure and can be easily disassembled for maintenance. By disassembling the cover section 32, the openclose body 36 and the spring 34 can be taken out. Because of the simple structure and small number of parts, the maintenance of the valve, for example, the removing of salt, can be easily executed. Through proper maintenance, the watertight function of the dry suit can be maintained.

Next, action of the automatic air outlet valve 12 will be explained.

When the outer water pressure is higher than the inner air pressure of the dry suit 10, the open-close body 36 of the automatic air outlet valve 12 is moved against the elasticity of the spring 34, so that the air outlet 26 is opened. The air outlet 26 is opened and the air is discharged from the dry suit 10 when the pressure difference is greater than a prescribed value. The air is discharged from the vent holes 33 via a groove 37*a* and a gap between the ring member 38 and the valve seat 28.

When the inner air pressure in the dry suit 10 is lower than the outer water pressure, the outer water pressure presses against the open-close body 36, so the ring member 38 of the open-close body 36 is urged onto the valve seat 28 and the air outlet 26 is closed. Namely, the water pressure working to the open-close body 36 securely watertightly closes the gap between the ring member 38 and the valve seat. The outer diameter of the holder section 37 is greater than the inner diameter of the air outlet 26, and the ring member 38 is sandwiched between an outer edge section 37*c* of the holder section 37 and the valve seat 28, so that the gap between the ring member and the valve seat can be securely watertightly closed. The holder section 37 and the ring member 38, whose inner edge is held in the outer edge section 37*c*, are supported by the valve seat 28, so that the open-close body 36 can be waterproof against the outer water pressure. By virtue of this structure, the open-close body 36 is never taken off by the outer water pressure.

As shown in FIG. 2, the thickness of an outer edge of the ring member 38, which is made of the elastic material, is thinner, and movement of the open-close body 36 is limited by the cover section 32. With this structure, the ring member 38 can be properly deformed and can securely close the valve seat 28 in a watertight manner when the outer water pressure works to the ring member 38. The outer edge section 38a of the ring member 38 is formed into a lip-shape, so that the open-close body 36 can sensitively respond to the pressure difference, and effectively work as the check valve.

The automatic air outlet valve 12 shown in FIG. 2 may be employed as the main air outlet valve 16, which is provided in the upper body part (for example, the upper arm part). Namely, the automatic air outlet valves 12 can be provided at the end sections of the leg parts (two end sections in the present embodiment) and the upper body part (one part in the present embodiment). The air in the dry suit can be automatically discharged in a reliable manner by employing the automatic air outlet valves for all air outlet valves, and manufacturing cost of the automatic air outlet valve 12 is less than that of a manual air outlet valve due to the simple structure. Where a plurality of the automatic air outlet valves 12 is employed, they never break simultaneously so the safety can be maintained. Thus, employing a plurality of the automatic air outlet valves 12 can substantially improve the safety as compared to a suit employing one air outlet valve.

The automatic air outlet valve, which can be automatically and manually operated, may be provided at the upper body part of the dry suit, thereby improving safety and reliability.

In the present embodiment, the dry suit has been explained as an example of the watertight suit. The present invention may however also be employed in a life jacket, which is capable of adjusting the buoyant force, fisherman's long rubber pants, etc.

Another air outlet valve for the watertight suit will be explained with reference to FIGS. 4–7. The air outlet valve of the present example can be automatically and manually operated, and it may be employed as the main air outlet valve 16 of the dry suit shown in FIG. 1.

Figure 4:
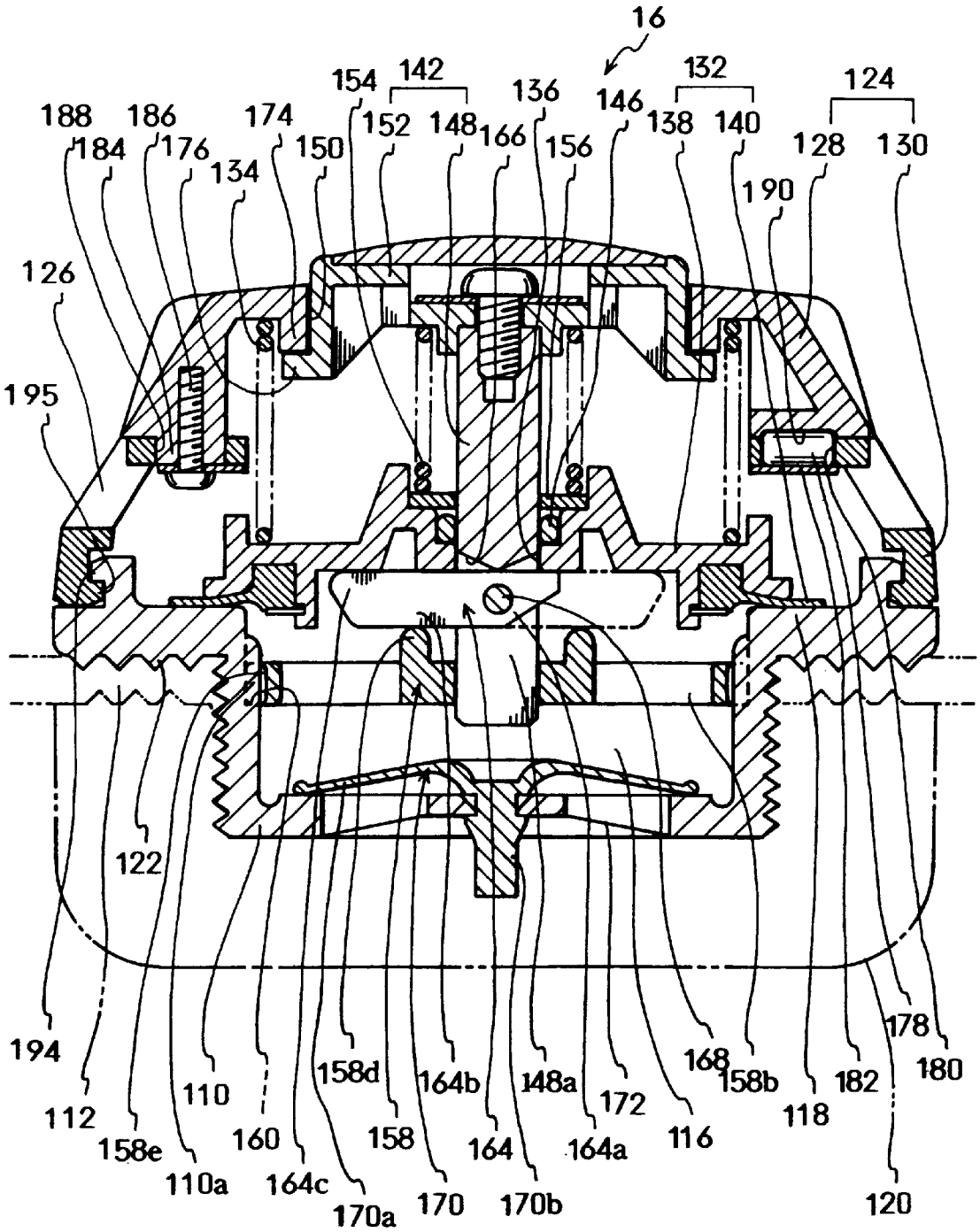
FIG. 4 is a sectional view of another air outlet valve.

FIG. 4 shows a sectional view of the automatic air outlet valve of the present example in which a valve seat is closed.

A base section 110 is attached to an opening section, which is formed in a suit material 112 of the diving suit (the dry suit), so that the base section 110 forms an air outlet 116. A valve seat 118 is formed in an edge of the air outlet 116. In the present embodiment, a male screw section of the base section 116 is threadably engaged with a female screw section of a back cap 120, which is provided on an inner side of the suit material 112. The suit material 123 is pinched between the base section 110 and the back cap 120, so that the base section 110 can be fixed to the opening section of the suit material 112. Circular projections 122 are formed, which are coaxial to the opening section, on surfaces of the base section and the back cap which contact the suit material, so that the base section 110 and the back cap 120 can be watertightly fixed to the suit material 112.

A cover section 124 covers over the base section 110 and which is threadably engaged with the base section 110. The cover section 124 includes vent holes 126, which communicate with the outside of the dry suit, and an upper cover 128 and a lower cover 130, which are capable of mutually turning by a click mechanism.

Figure 5:
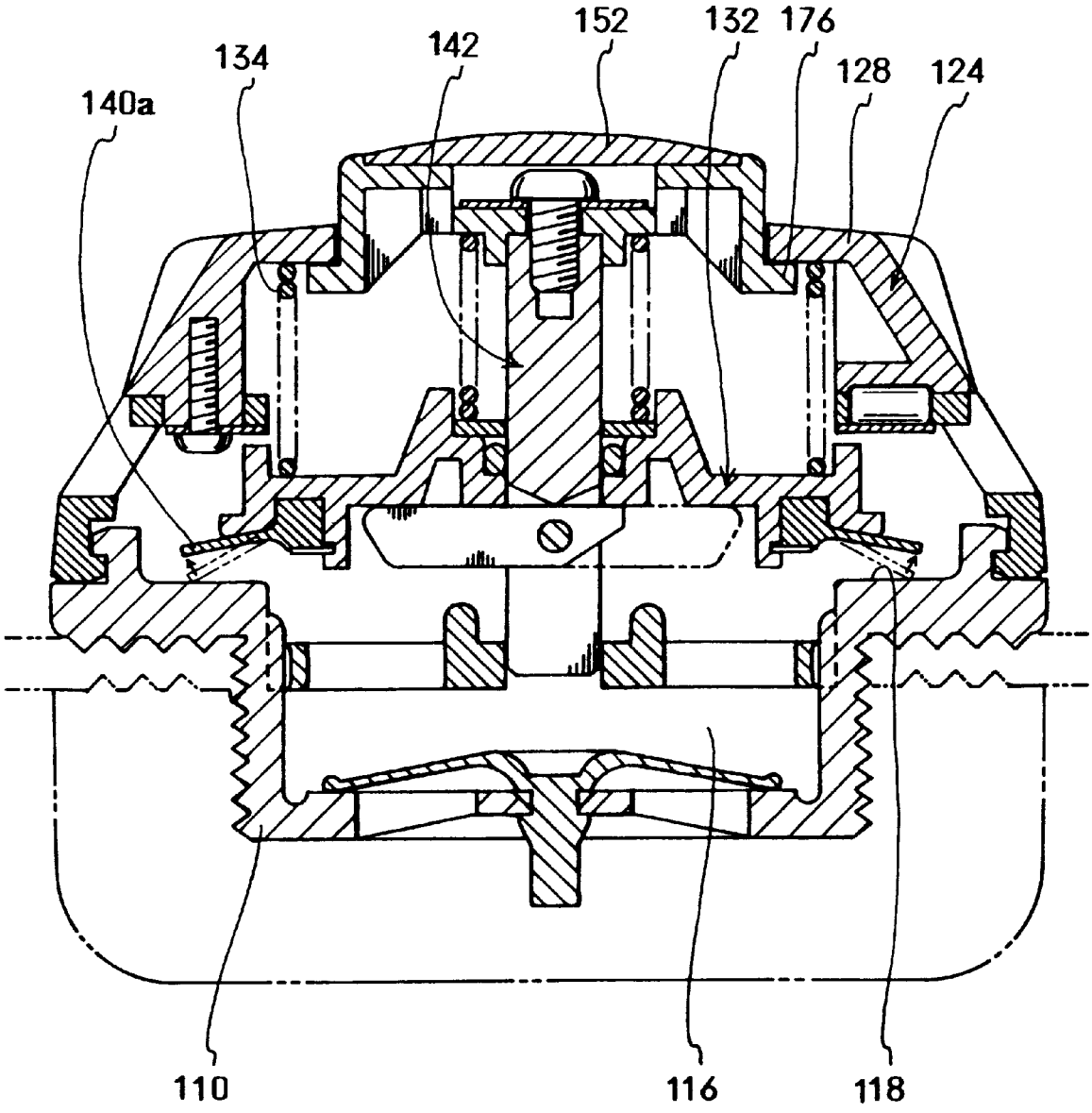
FIG. 5 is a sectional view of the air outlet valve shown in FIG. 4 in which the air is automatically discharged.

An open-close body 132 is provided, which is normally biased toward the valve seat 118 by a valve spring 134 elastically provided between an upper face of the open-close member 132 and an inner upper face of the cover section 124, to close the air outlet 116. The open-close body 132 automatically moves toward the outside of the dry suit (upward in the drawing) and opens the air outlet 116, as shown in FIG. 5, against the elasticity of the valve spring 134, when the inner air pressure of the dry suit is higher than the outer water pressure.

The open-close body 132 comprises a holder section 138 which is made of a tough material and which has a through-hole 136 in the center part, and a ring member 140, which is made of an elastic material, and whose outer edge is radially extended from an outer edge of the holder section 138. Unlike an open-close body wholly made of a tough material, the open-close body of the present embodiment is less deformed because the outer water pressure works to the holder section 138, so that the water cannot invade the dry suit.

A switching member 142 is provided, including a shaft section, which is pierced through and watertightly slidably fitted in the through-hole 136 formed in the center of the open-close body 138 with a seal ring 146, and a button section 152 provided to an outer end of the shaft section 148, whereby the switching member can be pushed toward the inside of the dry suit by a finger which is inserted in a through-hole 150 of the cover section 124. In the present embodiment, the button section 152 is conveniently fixed to the outer end of the shaft section 148 by a bolt.

A button spring 154 is elastically provided between an upper face of the open-close body 132 and a bottom face of the button section 152. The button spring normally biases the switching member 142 toward the outside of the dry suit. A washer 156 is provided to securely apply the biasing force of the button spring 154 to the upper face of the open-close body 132, and which locates the seal ring 146 at a predetermined position. In the present embodiment, the button spring 154 is a coil spring whose coefficient of elasticity is ten times as great as that of the valve spring 134.

Figure 7:
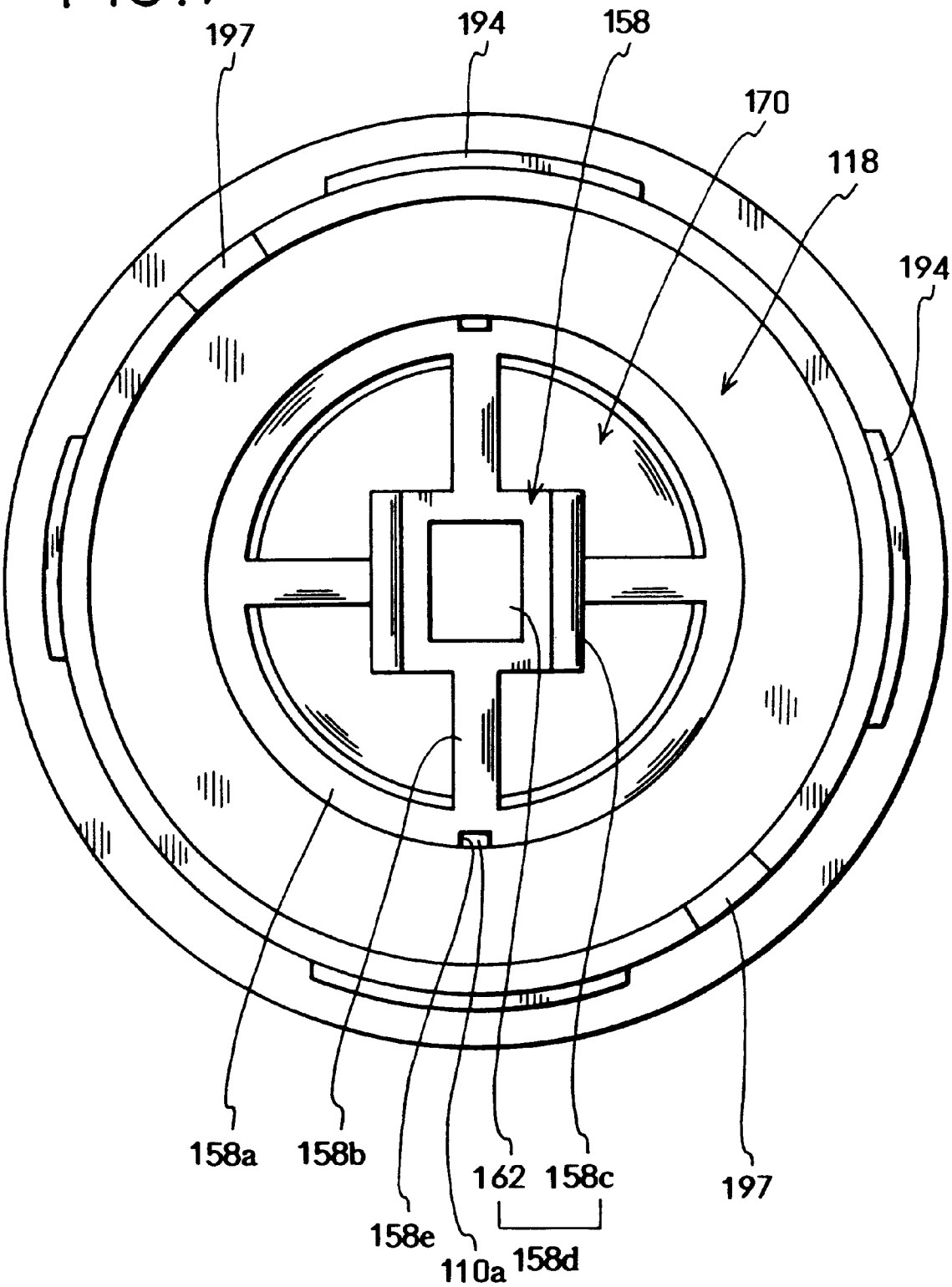
FIG. 7 is a plan view of a base section of the air outlet valve shown in FIG. 4.

A supporting section 158 is provided in the air outlet 116 of the base section 110. The supporting section 158 is engaged with a step section 160, which is formed in the air outlet 116, so that the supporting section can be upwardly detached from the air outlet 116. In the present embodiment, as shown in FIG. 7, the supporting section 158 includes a ring-shaped edge section 158*a* and rib sections 158*b* which are provided in the edge section and which are arranged like a cross so as not to close the air outlet 116. The supporting section further includes a supporting frame section 158*d*, which is provided in a center of the edge section and connected with the supporting ribs 158*b* and which has a rectangular through-hole 162 and a projected section 158*c*. Projected sections 110*a* of the base section 110 are respectively engaged with grooves 158*e* of the edge sections 158*a*, so that the supporting section 158 cannot be turned with respect to the base section 110.

Levers 164 are provided, each of which is connected to the supporting section 158 and the switching member 142, and which is moved toward the outside of the dry suit when the switching member 142 is pushed toward the inside of the dry suit, so that the open-close body 132 is moved to open the air outlet. A mid part 164*b* of the lever 164 is supported by the supporting section 158, one end 164*a* is connected to an end of the switching member 142, the other end 164*c* is located on the rear side of the open-close body 132, whereby the lever actuates the open-close body 132 to open the air outlet 116 when the switching member 142 is pushed toward the inside of the dry suit.

In the present embodiment, the one end 164*a* of the lever 164 is pivotably connected to a shaft 168 located in an end section 148*a* of the switching member 142. A slit is formed in the lower end section 148*a*, and a couple of levers 164 are pivotably connected to the shaft 168 in the slit, the ends 164*c* of which are radially extended from the slit in the opposite directions, such that they can be moved by the action of the open-close body 132. As shown in FIG. 4, the levers 164 bridge over the through-hole 136 in the state that the switching member 142 is not pushed inward, so that the switching member 142 can be kept in the open-close body 132. With this structure, the levers 164, the open-close body 132, the switching member 142 and the button spring 154 can be integrally disassembled, so that maintenance of the air outlet valve can be easily executed.

In the present embodiment, the ends 164*a* of the levers 164 are pivotably connected to the end section 148*a* of the switching member 142. However, it is noted that alternatively the mid parts 164*b* of the levers may be pivotably connected to projected section 158*d* of the supporting section 158 or the ends 164*c* thereof may be pivotably connected to the open-close body 132. In this case, a flange section is formed at the lower end of the switching member 142 whose diameter is greater than the inner diameter of the through-hole 136, so that the open-close body 132, the switching member 142 and the button spring 154 can be integrated. Note further, that the number of the levers 164 need not be limited to two.

Any means for moving the open-close body 132 away from the valve seat (for example, a planar cam mechanism) may be employed instead of the levers 164 without departure from the invention.

An inner valve 170 is provided which comprises a circular open-close section 170*a*, and a pillar section 170*b* integrated to a center of the open-close section. An upper part of the pillar section 170*b* is fitted and fixed in a center through-hole of a supporting beam section 172, which is provided at a lower end of the base section 110 and whose beams are radially extended. The inner valve 170 does not close the air outlet.

The inner valve 170 opens the air outlet 116 when the inner pressure of the dry suit is higher than the outer pressure thereof. It closes the air outlet 116 when the inner pressure of the dry suit is lower than the outer pressure thereof so that the water cannot invade the dry suit. Maintenance of the inner valve 170 can be executed after the supporting section 158 is disassembled from the base section 110.

Next, a locking mechanism, which locks an automatic air outlet mechanism by preventing the open-close body 132 from automatically opening the air outlet 116 when the inner pressure is higher than the outer pressure thereof, will be explained. FIG. 4 shows a state in which the automatic air outlet mechanism is locked, and FIG. 5 shows a state in which the automatic air outlet mechanism is unlocked.

As shown in FIG. 4, a locking section 174, which is downwardly projected from an inner edge of the through-hole 150 of the upper cover 128 of the cover section 124, is engaged with a flange section 176, which is radially extended from a lower end of the button section 152 of the switching member 142. Since the switching member 142 cannot be moved toward the outside of the dry suit when the locking section 174 is engaged with the button section 152 (the switching member 142), the open-close body 132, which is biased by the valve spring 134 and the button spring 154, cannot move toward the outside of the dry suit. Namely, the automatic air discharging action can be locked. In the present embodiment, the coefficient of elasticity of the button spring 154 is advantageously much greater than the valve spring 134, so the open-valve body 132 is prevented to open the air outlet 116, and the mechanism including the locking section 174, which can be engaged with the flange section 176, acts as the locking mechanism.

In the case of the unlock state in which the locking section 174 is disengaged from the flange section 176 of the button section 152, the switching member 142 can be moved toward the outside of the dry suit as shown in FIG. 5, so that the air in the dry suit can be automatically discharged.

The lock state and the unlock state of the locking mechanism are selected by the click mechanism by which the upper cover 128 and the lower cover 130 can be relatively turned in a predetermined range.

In the embodiment of FIG. 4, rollers 178 are respectively provided in through-holes 180 of an inner flange part of the lower cover 130 and which are rotatably held between a circular leaf spring 182 and a lower face of the upper cover 128. The leaf spring 182 is provided on a bottom face of the inner flange part of the lower cover 130 to form bottoms of the holes 180 and fixed to a plurality of projected sections 184, which are downwardly projected from the upper cover 128, by bolts 186. The projected sections 184 are respectively fitted in long through-holes 188 of the upper cover 128 such that the upper cover 128 and the lower cover 130 can be relatively moved in a range defined by the long through-holes 188. An outer diameter of each of the rollers 178 is slightly greater than the thickness of the inner flange part of the lower cover 130, which includes the through-holes 180, and the rollers rotatably contact a bottom face of the upper cover 178. Two cavities 190 and 192 for one roller 178 are formed in the bottom face of the upper cover 178.

In the above-described click mechanism, the roller 178 is held in the cavity 190 by the elasticity of the leaf spring 182 when the locking section 174 of the upper cover 128 engages with the flange section 176 of the button section 152. When the upper cover 128 is turned in one direction with respect to the lower cover 130, the rollers 178 are moved from the cavities 190 against the elasticity of the leaf spring 182, and the rollers 178 fitted in the cavities 192 by further turning the upper cover 128, so that the automatic air outlet mechanism is unlocked. By employing the click mechanism, the automatic air outlet mechanism can be securely locked and unlocked. Note that the end section 148*a* of the switching member 142 is formed into a rectangular shape and fitted in a rectangular through-hole 162 (see FIG. 7) of the supporting section 158, which cannot turn with respect to the base section 110, so that switching member 142 also cannot turn with respect to the base section 110 and the lower cover 130 fixed to the base section 110.

The cover section 124 is detachably connected to the base section by a bayonet mechanism, which is usually employed in cameras. Namely, the bayonet mechanism comprises a plurality of outer projections 194 which are outwardly projected from an outer edge of the base section 110, a plurality of inner projections 195 which are inwardly projected from an inner edge of the cover section 124 and capable of respectively engaging with the outer projections and a stopper (not shown) for preventing the cover section 124 from disassembling from the base section 110.

Next, the action of the air outlet valve will be explained.

Figure 6:
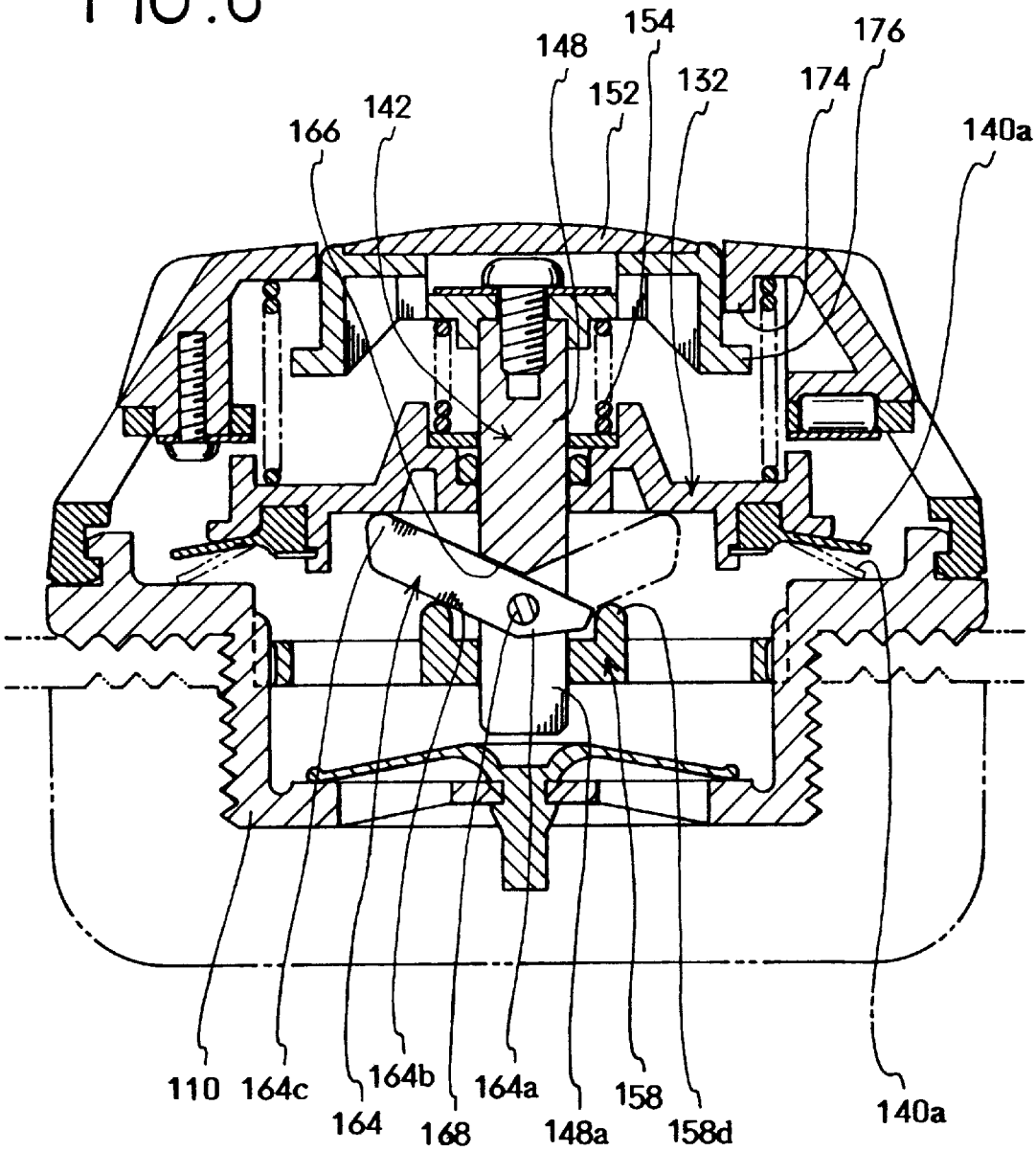
FIG. 6 is a sectional view of the air outlet valve shown in FIG. 4 in which the air is manually discharged.

When the button section 152 is pushed by a finger, the switching member 142 is moved toward the inside of the dry suit. The levers 164, whose one ends 164*a* are pivotably connected to the switching member 142, are supported at the mid parts 164*b* by the supporting section 158, and the other ends 164*c* of the levers contact and move the open-close body 132 to open the air outlet 116. By this action, the air in the dry suit can be discharged. Note that, as shown in FIG. 6, slopes 166 limit the turn of the levers 164, so that the levers 164 can be turned in the predetermined angle.

When the inner air pressure of the dry suit is higher than the outer water pressure, the open-close body 132 is moved, against the elasticity of the valve spring 134, to open the air outlet 116, so that the outer edge section 140*a* of the ring member 140 is moved in the direction of arrows shown in FIG. 5 to discharge the air in the dry suit.

Therefore, the open-close valve 132 can be automatically and manually moved to discharge the air. Furthermore, it can be easily disassembled, so maintenance can be easily executed.

In the air outlet valve of the present embodiment, if the button section 152 is accidentally pushed, the switching member 142 cannot be easily pushed inward because the outer water pressure works to the open-close body 132 when the inner air pressure is lower than the outer water pressure, so that greater force is required to move the open-close body 132 to open the air outlet 116. If the outer water pressure is much higher than the inner air pressure, it is difficult to manually move the open-close body 132. Thus, the water invasion into the dry suit can be securely prevented.

When the inner air pressure is almost equal to the outer water pressure, even if the button section 152 is accidentally pushed, the outer edge section 140*a* of the ring member 140 contacts the valve seat 118 as shown by two-dot chain lines in FIG. 6, so the water invasion can be prevented.

An air inlet valve for the dry suit will now be explained with reference to FIGS. 8–10. The air inlet valve of the present embodiment can automatically and manually introduce the air, so it can be employed as the air inlet valve 14 of the dry suit shown in FIG. 1.

Figure 8:
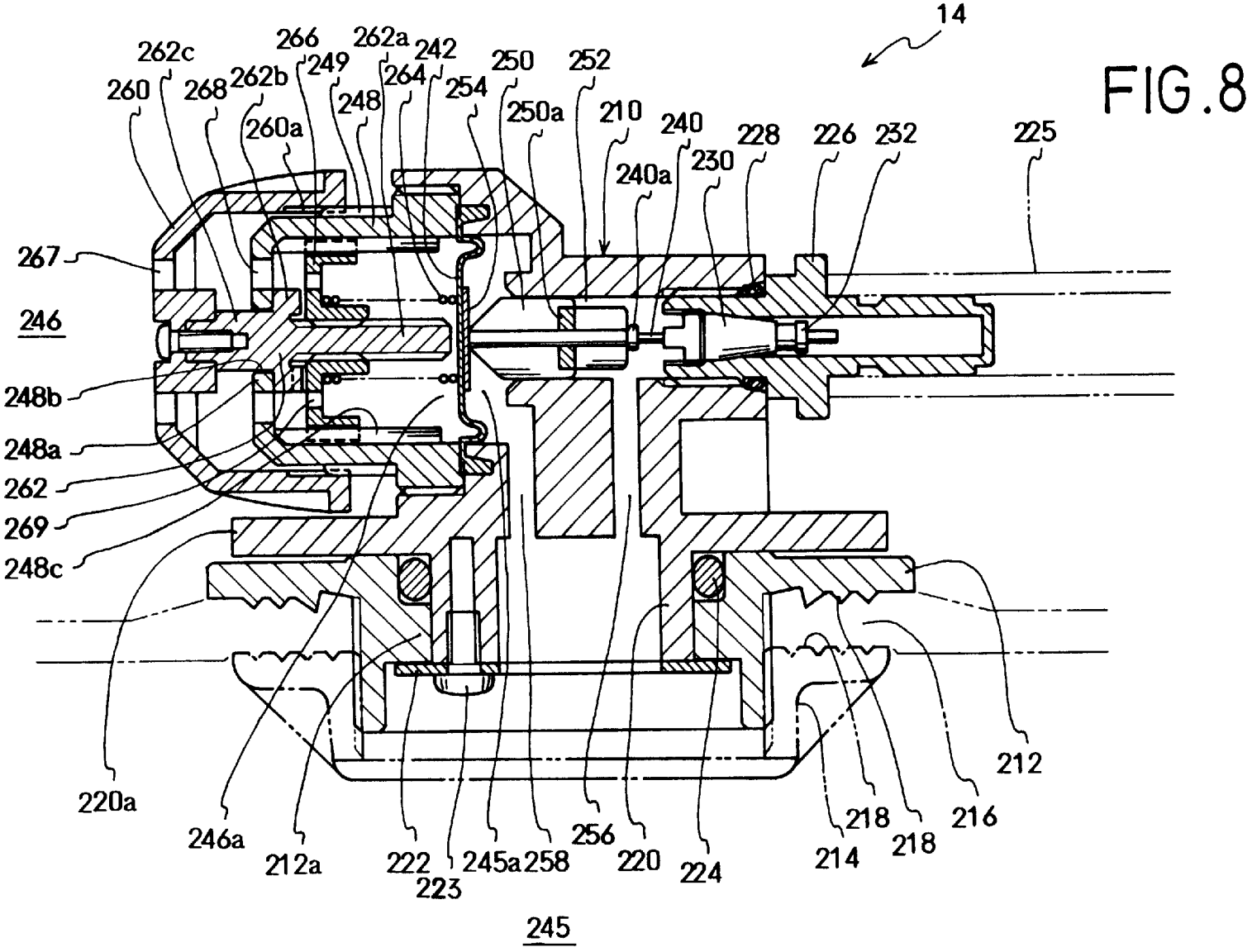
FIG. 8 is a sectional view of an automatic air inlet valve for the watertight suit.
Figure 9:
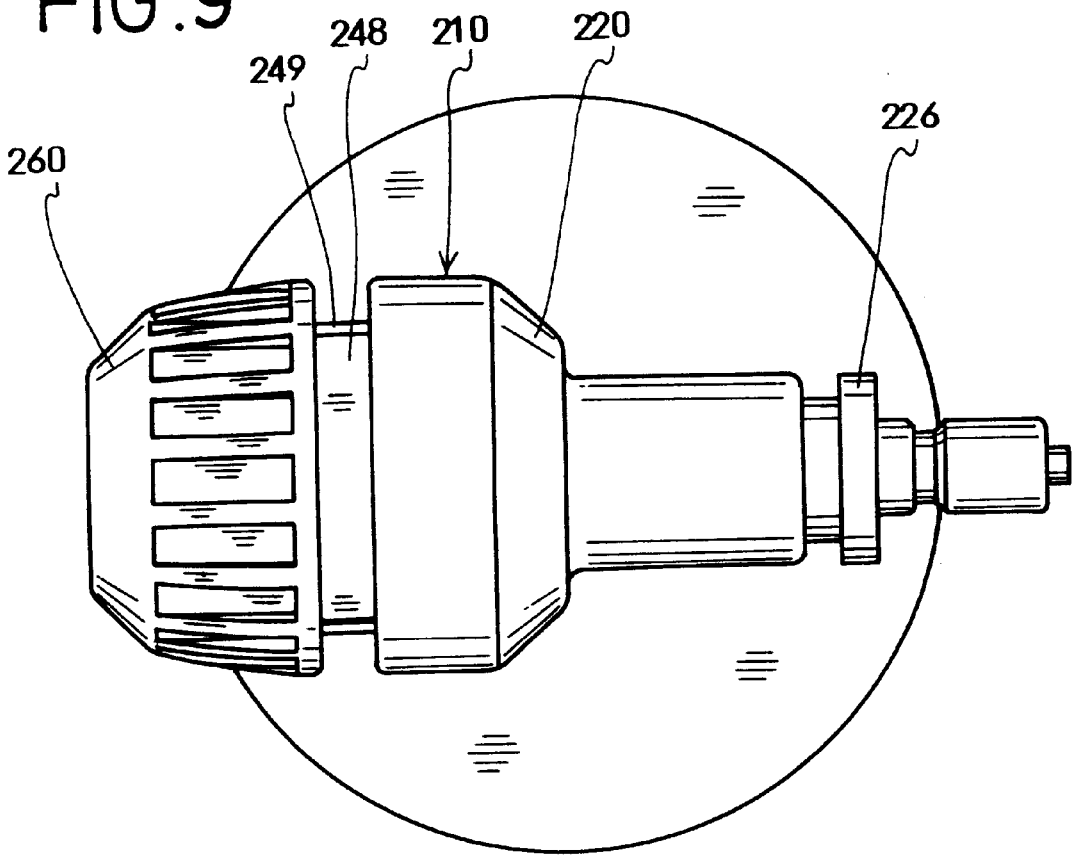
FIG. 9 is a plan view of the automatic air inlet valve shown in FIG. 8.

FIG. 8 is a sectional view of an example of the air inlet valve for the dry suit, in which the air inlet valve is in a closing state. FIG. 9 is a plan view of the air inlet valve shown in FIG. 8.

A body proper 210 is connected to the dry suit for introducing the compressed air from an air tank (not shown). The air inlet valve is fixed to the dry suit by pinching an edge 216 of a hole of the dry suit between a fixed ring 212 and a back cap 214. The back cap 214 is threaded to the fixed ring 212, so the edge 216 of the dry suit is fixed by tightly screwing both together. Coaxial circular projections 218 are formed on surfaces of the fixed ring 212 and the back cap 214 which contact the edge 216, so that they can be watertightly fixed to the edge 216. An air inlet member 220 of the body proper 210 is rotatably attached to the fixed ring 212. An inner flange section 212*a*, which is formed on an inner circumferential face of the fixed ring 212 is sandwiched between a flange section 220*a* of the air inlet member 220 and a metallic plate 222, so that the air inlet member 220 can be rotated. The plate 222 is fixed to the air inlet member 220 by bolts 223. A symbol 224 indicates a seal ring, which airtightly closes the gap between the fixed ring 212 and the air inlet member 220.

The air inlet member 220 is communicative with the air tank via an air hose 225. A coupler 226 is provided for purposes of attaching the air hose, and is threadably engaged with the air inlet member 220 and airtightly fixed by a seal ring 228. A tire valve 230, which is usually employed in tires of vehicles, is threadably engaged with, and fixed to, the coupler 226. Ordinary tire valves, which have enough reliability, can be conveniently employed.

The tire valve 230 is provided in the body proper 210, communicative with the inside of the dry suit. The tire valve comprises an air path for introducing the compressed air supplied from the air tank and a closing member 232, which is always biased to close the air path by an inner spring and which opens the air path by moving against the elasticity of the inner spring. As shown in FIG. 10 (the sectional view), for example, the air path 234, the closing member 232 and the inner spring 236 are arranged in the tire valve. The air path 234 is made of a tubular member 238. An airtight member (for example, comprised of a suitable rubber) is provided on a surface of the closing member 5 232, which is capable of contacting an end 238*a* of the tubular member 238 to close and open the air path 234.

A pin 240 is pierced through the tubular member 238, one end of which is fixed to the closing member 232 and the other end of which is projected from the other end 238*b* of the tubular member 238. The pin 240 includes a head section 240*a* whose diameter is made greater than a remainder thereof. The inner spring 236 is elastically provided between a large diameter section 240*b*, which is formed at a mid part of the pin 240, and a step section 240*c* of the tubular member 238. By virtue of this structure, the inner spring 236 normally biases the closing member 232 to close the air path 234, and the closing member 232 opens the air path 234 to introduce the compressed air into the dry suit when the pin 240 is pushed.

Figure 10:
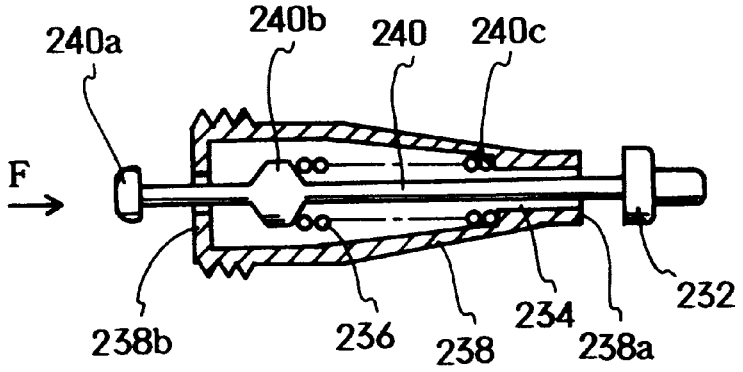
FIG. 10 is a sectional view of a conventional tire valve.

In FIG. 10, the pin 240 is moved against the elasticity of the inner spring 236 by an external force "F". In the case of applying no external force "F", the closing member 232 contacts the end 238*a*, and the head section 240*a* cannot be projected more than a predetermined length. Note that, in FIG. 8, the head section 240*a* is maximally projected.

A diaphragm 242 is provided, which airtightly divides an inner space into an inner space 245, which includes the air path 234 and the inside of the dry suit, and an outer space 246. An outer edge of the diaphragm 242 is pinched and fixed by a diaphragm holder 248, which is threadably engaged with the air inlet member 220. The diaphragm 242 deforms toward the inner space 245 when the pressure in the inner space 245 is lower than that of the outer space 246, so that the closing member 232 is moved against the elasticity of the inner spring so as to introduce the compressed air into the dry suit. In the present embodiment, the diaphragm 242 pushes the pin 240 with a slider 250, which is movably provided between the tire valve 230 and the diaphragm. The slider 250 is capable of linearly and reciprocatively moving in a path 252 which connects the tire valve 230 with the diaphragm. A circular partition 250*a* is formed, whose outer diameter is shorter than the inner diameter of the path 252, at a mid part of the slider. By virtue of the partition 250*a*, the pressure of the compressed air, which is introduced via the tire valve 230, never influences the diaphragm 242. The air can flow through a gap between an inner circumferential face of the path 252 and the partition 250*a*, so that the compressed air can be introduced into a space located on the inner side of the diaphragm 242. A metallic reinforcing plate 254 is fixed on an inner face of the diaphragm 242, which contacts the slider 250. A stainless steel plate may be employed as the metallic plate 254. The metallic plate 254 may be fixed to the diaphragm 242, which is made of an elastic material, for example silicone rubber, with an adhesive, or by an insert-molding manner.

A first path 256 is provided, which is communicative with the air path to introduce the compressed air into the dry suit, and which connects the path 252 to the inner space 245. A second path 258 is also provided, which is communicative with the inside of the dry suit, which introduces the compressed air into the space located on the inner side of the diaphragm 242, and which connects the space 245*a* located on the inner side of the diaphragm 242 to the inner space 245.

If the pressure in the body proper 210 is temporally made higher than the pressure in the dry suit by the compressed air jetted out from the tire valve 230, the diaphragm 242 is biased toward the outside, so that the compressed air cannot be properly supplied. However, this trouble can be prevented by employing the first path 256 and the second path 258.

An adjusting dial 260 is provided, which can be rotated, and whose cavities 260*a*, which are formed in an inner circumferential face, engage with click claws 249, which are projected from an outer circumferential face of the diaphragm holder 248. By elasticity of the adjusting dial 260, the click claws 249 are fitted in the cavities 260*a*, so accidental rotation of the adjusting dial can be prevented. A screw shaft 262, whose front end section is formed into a male screw section 262*a*, is fixed onto an inner part of the adjusting dial 260 by a bolt. A flange section 262*b*, which is formed at a mid part of the screw shaft 262, contacts an inner part 248*a* of the diaphragm holder 248, so that the adjusting dial 260 cannot be pulled out toward the outer space 246.

Since the rear end section 262*c* of the screw shaft 262 is inserted in a hole 248*b* of the diaphragm holder 248, the adjusting dial 260 can be reciprocatively moved in the axial direction. By virtue of this structure, when the adjusting dial 260 is pushed inward, it contacts the diaphragm 242, and the diaphragm 242 is bent from the outer space 246 toward the inner space 245, so that a center part of the diaphragm, on which the metallic plate 254 is fixed, can be moved. By this action, the slider 250, which contacts the diaphragm 242, is also moved, then the pin 240 of the tire valve 230 is moved against the elasticity of the inner spring 236, so that the closing member 232 opens the air path 234. Namely, the adjusting dial 260 moves the closing member 232 against the elasticity of the inner spring 236 to open the air path 234, so that the adjusting dial acts as a manual air inlet button for opening the air path.

A symbol 264 indicates an outer spring, which biases the diaphragm 242 against the elasticity of the inner spring 236, and whose elasticity is balanced with that of the inner spring 236. In the present embodiment, the outer spring 264 is a coil spring whose one end contacts the diaphragm 242. A spring holder 266 is provided, which is screwed with the male screw section 262*a* of the screw shaft 262, and which is capable of reciprocatively moving along linear guides 248*c*, which is provided in the diaphragm holder 248 parallel to the axial line of the adjusting dial 260. Since the spring holder 266 is guided by the linear guides 248*c*, the spring holder cannot rotate and is reciprocatively moved in a linear direction by rotating the adjusting dial 260 together with the screw shaft 262. By virtue of this structure, the spring holder 264 can adjust the distance from the surface of the diaphragm 242 to which the one end of the outer spring 264 elastically contacts, so that the spring holder can adjust the elasticity of the outer spring 264.

As described above, the diaphragm 242 is normally biased by the inner spring 236 and the outer spring 264. The pin 240 should be pushed with greater force so as to work the tire valve 230, so the area of the diaphragm 242 should be large to securely work the air inlet valve on the basis of the pressure difference between the inner pressure and the outer pressure. In the air inlet valve of the present embodiment, the elasticity can be adjusted by the adjusting dial 260, so that the diaphragm 242 having a small area can be employed, and the proper pressure difference between the inner pressure and the outer pressure, which is defined on the basis of divers' physical characteristics, diving positions, etc., can be set. Namely, the length of the outer spring 264 can be changed by moving the spring holder 266, so that the biasing force of the outer spring, which works to the diaphragm 242, can be changed. By changing the biasing force, the predetermined pressure difference (sensitivity) of the beginning air supply can be adjusted. In the case of optionally supplying the air, the compressed air can be introduced into the dry suit by pushing the adjusting dial 260. With above-described structure, the air inlet valve can be small in size, manufacturing cost can be reduced, and the reliability can be improved.

In the case of setting the biasing force of the inner spring 236 low or providing the diaphragm 242 with a greater diameter, the pressure difference between the inner pressure and the outer pressure can be small, so that the biasing force of the outer spring 264 may be unnecessary.

The adjusting dial 260, the diaphragm holder 248 and the spring holder 266 respectively have holes 267, 268 and 269, so the outer space 246 is communicated to a space 246*a*, in which the outer surface of the diaphragm 242 exists. The holes 267, 268 and 269 should easily introduce the water from the outer space 246 to the space 246*a*, in which the outer surface of the diaphragm 242 exists.

In the present embodiment, when the pressure of the inside of the diaphragm is lower than that of the outside thereof, the diaphragm is bent inward so that the closing member is moved against the elasticity of the inner spring and the air path is opened to introduce the compressed air from the air tank to the dry suit. Since the compressed air can be automatically introduced into the dry suit, the diver need not execute a complex operation.

The preferred embodiments of the present invention have been described above, but the present invention is not limited to the above embodiments, and many modifications may be allowed without deviating the spirit of the invention.

We claim:

1. A watertight suit in which air is supplied from an external air source, comprising:

a shell presenting an interior space and an exterior, and including an upper body part and a leg part, said shell being comprised of a material and a construction inhibiting invasion of water into said interior space;

a first automatic outlet valve disposed in said upper body part;

a second automatic outlet valve disposed in an end section of said leg part;

said first automatic outlet valve and said second automatic outlet valve each including means for automatically discharging air for said interior space when an inner pressure is higher than a prescribed pressure in excess of an outer pressure exerted on said exterior of said shell, said first automatic outlet valve and said second automatic outlet valve each further including means for inhibiting passage of water from an exterior thereof into said interior of said shell even when the outer pressure is higher than the inner pressure; and an automatic air inlet valve for receiving air from the external air source, said automatic air inlet valve including means for automatically allowing passage of air supplied from the external air source into said interior of said shell when the inner pressure is lower than prescribed pressure which is below the outer pressure.

2. A watertight suit according to claim 1, wherein each of said first automatic outlet valve and said second automatic outlet valve comprises:

a base section fixed to said shell, said base section including an air outlet and a valve seat formed on an edge defining a boundary of said air outlet;

a cover section including a vent hole communicative with an outside of said shell, said cover section being removably attached to and overlaying said base section, said cover section and said base section defining a an enclosed space therebetween;

an open-close body disposed in said enclosed space;

said open-close body including a holder section comprised of a tough material, said holder section being dimensioned larger than said air outlet whereby said air outlet can be completely covered thereby;

said open-close body further including a ring member comprised of an elastic material, an edge of said ring member being formed into a thin lip-shape, said ring member including means for closing a gap between said holder section and said valve seat in a manner blocking passage of water thereacross; and biasing means for biasing said open-close body toward said valve seat to close said air outlet, said biasing means providing a biasing force which is overcome when said inner pressure is higher than said prescribed pressure in excess of said outer pressure.

3. A watertight suit according to claim 2, wherein said biasing means includes means for adjusting said biasing force.

4. A watertight suit according to claim 1, wherein said automatic air outlet valve comprises a diaphragm air-tightly dividing said interior space of said shell from an outside thereof, said diaphragm including means for inward deformation, said means for inward deformation being operable to permit introduction of air from the external air source to said interior space of said shell when the inner pressure is lower than a prescribed pressure which is below the outer pressure.

5. A watertight suit according to claim 1, wherein said first automatic air outlet valve includes means for manual operation, said first automatic air outlet valve comprising:

a base section fixed to said shell, said base section including an air outlet and a valve seat formed on an edge defining a boundary of said air outlet;

a cover section including a vent hole communicative with an outside of said shell, said cover section being removably attached to and overlaying said base section, said cover section and said base section defining a an enclosed space therebetween;

an open-close body disposed in said enclosed space including means for selectively opening and closing said air outlet, said open-close body including a through-hole formed in a center thereof;

biasing means for biasing said open-close body toward said valve seat to close said air outlet, said biasing means providing a biasing force which is overcome when the inner pressure is higher than said prescribed pressure in excess of said outer pressure;

a switching member including a shaft section which is slidably received in said through-hole in said open-close body in watertight engagement therewith, said switching member further including a button section disposed at an outer end of said shaft section, said switching member being urgable in a direction toward said interior space of said shell by applied pressure;

button biasing means for biasing said switching member in a direction outward of said shell; and means responsive to movement of said switching member in said direction toward said interior space of said shell for urging said open-close body is a direction opening said air outlet.

6. A watertight suit according to claim 5, wherein said means responsive to movement of said switching member includes:

a supporting section disposed in said air outlet; and a pushing member in supported contact with said supporting section and connected with said switching member.

7. A watertight suit according to claim 5, wherein said pushing member is formed into a lever shape which is supported at a mid-portion of said supporting member, a one end of said pushing member being connected to a front end of said switching member, and a remaining end of said pushing member being located on a rear side of said switching member, said pushing member moving said open-close body to a position opening said air outlet when said switching member is pushed toward the inside of said shell.

* * * * *